US008258709B2

(12) United States Patent
Moskowitz

(10) Patent No.: US 8,258,709 B2
(45) Date of Patent: Sep. 4, 2012

(54) LED CONTROL USING MODULATION FREQUENCY DETECTION TECHNIQUES

(75) Inventor: Philip E. Moskowitz, Georgetown, MA (US)

(73) Assignee: Osram Sylvania Inc., Danvers, MA (US)

( * ) Notice: Subject to any disclaimer, the term of this patent is extended or adjusted under 35 U.S.C. 154(b) by 262 days.

(21) Appl. No.: 12/874,201

(22) Filed: Sep. 1, 2010

(65) Prior Publication Data

US 2012/0049743 A1 Mar. 1, 2012

(51) Int. Cl.
*H05B 37/02* (2006.01)

(52) U.S. Cl. ..... 315/152; 315/308

(58) Field of Classification Search ..... 315/149, 315/152, 246, 291, 299, 307, 308
See application file for complete search history.

(56) References Cited

U.S. PATENT DOCUMENTS

| | | | | |
|---|---|---|---|---|
| 6,153,985 | A | 11/2000 | Grossman | |
| 7,557,518 | B2 | 7/2009 | Zagar et al. | |
| 7,671,542 | B2 | 3/2010 | Chang et al. | |
| 7,800,315 | B2 * | 9/2010 | Shteynberg et al. | 315/291 |
| 7,956,554 | B2 * | 6/2011 | Shteynberg et al. | 315/293 |
| 8,159,150 | B2 * | 4/2012 | Ashdown et al. | 315/307 |
| 2007/0115662 | A1 | 5/2007 | Roberts et al. | |
| 2008/0309255 | A1 | 12/2008 | Myers et al. | |
| 2009/0251067 | A1 | 10/2009 | Johnson | |

FOREIGN PATENT DOCUMENTS

| | | | |
|---|---|---|---|
| EP | 1635617 | A2 | 3/2006 |
| WO | W02007/121574 | A1 | 11/2007 |
| WO | W02009/019655 | A1 | 2/2009 |

OTHER PUBLICATIONS

Jon Martis, Closed Loop Chromaticity Control: Interfacing a Digital RGB Color Sensor to a PIC24 MCU, Microchip AN1257, DS01257A, Microchip Technology Inc., 2009.

Xiaohui Qu et al., Color Control System for RGB LED Light Sources Using Junction Temperature Measurement, The 33rd Annual Conference of the IEEE Industrial Electronics Society (IECON), Nov. 5-8, 2007, Taipei, Taiwan.

International Search Report for International application PCT/US2011/050192 mailed Dec. 27, 2011.

* cited by examiner

*Primary Examiner* — Thuy Vinh Tran

(74) *Attorney, Agent, or Firm* — Robert F. Clark; Andrew Martin

(57) ABSTRACT

In one embodiment, the present disclosure provides a method for controlling a plurality of LED channels. The method includes receiving an LED brightness signal having a plurality of superimposed pulse width modulated (PWM) brightness signals each having a duty cycle and amplitude at a unique modulation frequency, each PWM brightness signal being proportional to the brightness of a respective LED channel. The method also includes determining a pulse area of each PWM brightness signal at each respective unique frequency. The pulse area is proportional to the product of the amplitude and the duty cycle. The method also includes generating pulse area signals proportional to the respective pulse area and comparing the respective pulse area signals to user defined and/or preset photometric values to generate respective error signals proportional to the difference between the respective pulse area signals and the user defined and/or preset photometric values.

25 Claims, 4 Drawing Sheets

LED CONTROL USING MODULATION FREQUENCY DETECTION TECHNIQUES

FIELD

The present application relates to LED control using modulation frequency detection techniques, and more particularly, to LED brightness and/or color control based on unique modulation frequencies used to drive independent LED strings.

BACKGROUND

LED control, in general, cannot be accomplished solely through the precise control of LED manufacturing variables, since the operating environment of the LED (temperature, current stability, infiltration of other light sources, etc.) may affect the color and intensity of the LED device. Known feedback control systems are used to control color and intensity of LEDs. One such known system involves the use of multichannel light sensors tuned to each color in the system. For example, a typical RGB system includes a string of red LEDs, a string of green LEDs and a string of blue LEDs. A multichannel RGB light sensor is placed in proximity to the light source in a location that is optimized to receive light flux from all three emitters. The sensor outputs signals indicative of the average total flux and the color point of the RGB system. A feedback controller compares this information to a set of preset or user-defined values. The multichannel sensor adds complexity and cost to the system design and architecture, and, in most cases, suffers from a lack of 1:1 correspondence between the light sensor and LED channels, making the color point calculations complex and limiting their accuracy.

Another known feedback control system utilizes a broadband sensor to sense the light from the LED channels. To control each individual channel, all other channels must be turned off so that the sensor can "focus" on a single color at a time. Thus, this system does not lend itself to continuous, simultaneous and independent control of all the channels in the system.

BRIEF DESCRIPTION OF THE DRAWINGS

Reference should be made to the following detailed description which should be read in conjunction with the following figures, wherein like numerals represent like parts.

DETAILED DESCRIPTION

Generally, this application provides systems (and methods) for controlling the brightness of LEDs to compensate for uncontrolled changes in brightness and/or color. Temperature drift, aging of the LED devices, changes in the drive current, etc., can all cause changes in brightness, even if the duty cycle of the drive current to the LEDs remains fixed. To compensate for uncontrolled changes in brightness in one or more LED channels, one exemplary system drives each LED channel with a unique modulation frequency. Feedback control is provided that may utilize a single photodetector to sense the composite light from all the LED channels in the system, determine the amplitude of the light intensity at each unique modulation frequency, and compare that amplitude to preset and/or user programmable values to generate error signals. Each error signal, in turn, may be used to control the duty cycle in each channel to compensate for any detected changes in brightness. In some embodiments, all of the LED channels may be controlled simultaneously and continuously.

Figure 1:
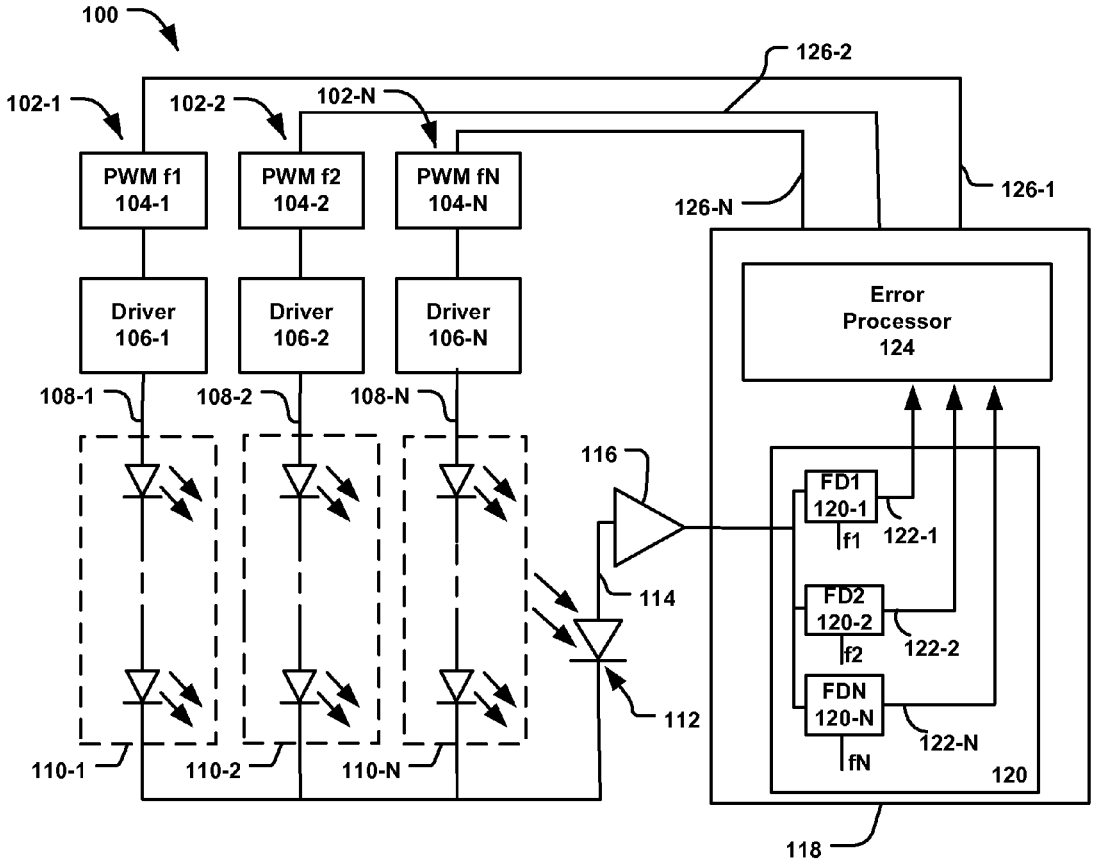
FIG. 1 is a diagram of one exemplary embodiment of a system consistent with the present disclosure.

FIG. 1 is a diagram of one exemplary embodiment of a system 100 consistent with the present disclosure. In general, the system 100 includes a plurality of light emitting diode (LED) channels 102-1, 102-2, . . . , 102-N, a photodetector 112 and an LED controller 118. Each respective LED channel may include pulse width modulation (PWM) circuitry 104-1, 104-2, . . . , 104-N, drive circuitry 106-1, 106-2, . . . , 106-N, and an LED string 110-1, 110-2, . . . , 110-N. Respective PWM circuitry 104-1, 104-2, . . . , 104N may be configured to generate respective PWM signals, each having a unique modulation frequency f1, f2, . . . , fN and to set the duty cycle of the respective PWM signals, based on feedback information as will be described in greater detail below. Each modulation frequency f1, f2, . . . , fN may be selected to be large enough to reduce or eliminate perceptible flicker, for example, on the order of several hundreds to several thousand Hz. Also, to reduce or eliminate perceptible "beat" effects caused by having the on/off time of one channel too near the on/off time of another channel, each modulation frequency may be selected so that it is not within several hundreds of Hertz of other modulation frequencies.

Figure 2A:
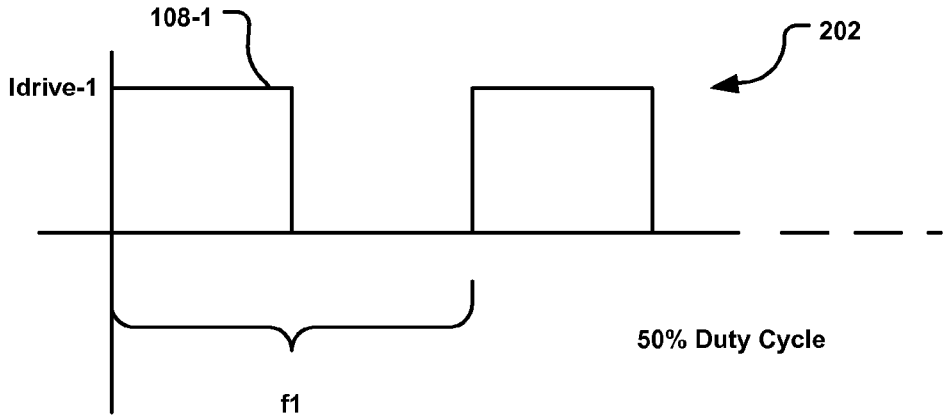
FIG. 2A is a signal diagram of a modulated current signal consistent with the present disclosure.

Driver circuitry 106-1, 106-2, . . . , 106-N may be configured to supply current to each respective LED string 110-1, 110-2, . . . , 110-N. Driver circuitry may include known DC/DC converter circuit topologies, for example, boost, buck, buck-boost, SEPIC, flyback and/or other known or after-developed DC/DC converter circuits. Of course, driver circuitry may also include AC/DC inverter circuitry if, for example, the front end of the drive circuitry is coupled to an AC power source. The current supplied by each driver circuitry may be the same, or different depending on, for example, the current requirements of each respective LED string. Typically, driver circuitry 106-1, 106-2, . . . , 106-N is configured to generate a maximum drive current, Idrive, that can power the LED string at full intensity. In operation, drive circuitry 106-1, 106-2, . . . , 106-N is configured to power a respective LED string 110-1, 110-2, . . . , 110-N with a respective modulated DC current 108-1, 108-2, . . . , 108-N that is modulated by a respective PWM signal modulated at a respective modulation frequency f1, f2, . . . , fN, having a respective duty cycle set by respective PWM circuitry 104-1, 104-2, . . . , 104N. Referring briefly to FIG. 2A, an example of modulated drive current 108-1 in the first channel 102-1 is depicted. The modulated current signal 202 in this example is modulated at a frequency of f1. Assuming a 50% duty cycle, the current Idrive is delivered to LED string 110-1 during the ON time of the first half of a period of f1, and no current is delivered to LED string 110-1 during the OFF time of the second have of a period of f1. To control the overall brightness in each LED string, the duty cycle of each respective PWM signal may be adjusted. For example, the duty cycle in each channel may independently range from 0% (fully off) to 100% (fully on) to control the overall brightness (luminosity) and of each respective string. Color and/or brightness control, as described herein, may be accomplished by controlling the brightness of each LED string independently of the other strings.

Referring again to FIG. 1, each LED string 110-1, 110-2, . . . , 110-N may include one or more individual LED devices. Each string may be arranged by color, for example a red, green, blue (RGB) topology in which string 110-1 may include one or more LEDs that emit red light, string 110-2 may include one or more LEDs that emit green light and string 110-N may include one or more LEDs that emit green light. Of course, this is only an example and other color arrangements are equally contemplated herein, for example, RGW (red, green, white), RGBY (red, green, blue, yellow), infrared, etc., without departing from this embodiment. While the system of FIG. 1 depicts multiple LED strings 110-1, 110-2, . . . , 110-N, this embodiment may instead include a single LED string. Since the power to each LED in each respective LED string may be modulated by each respective modulation frequency f1, f2, . . . , fN, the brightness signal emitted by each LED string may have similar features as the PWM signal that modulates its power.

Figure 2B:
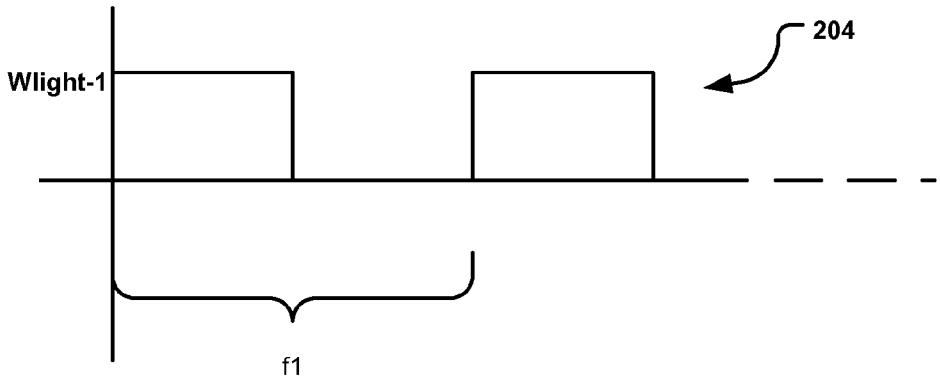
FIG. 2B is a signal diagram of a PWM brightness signal consistent with the present disclosure.

Photodetector circuitry 112 may be configured to detect superimposed PWM brightness signals from the LED strings and generate an LED brightness signal 114 (e.g., current signal) proportional to the superimposed PWM brightness signals. To enable simultaneous control of all the LED strings in the system, photodetector 112 may be configured to detect the combined, superimposed PWM brightness signals of all the LED sources. An example of a PWM brightness signal for channel 102-1 is depicted in FIG. 2B. Again assuming a 50% duty cycle of the PWM signal, the brightness signal 204 is modulated with a frequency f1, and may swing from an amplitude of Wlight-1 to zero, according to the duty cycle in channel 102-1. In this example, Wlight-1 may be proportional to the average flux emitted by LED string 110-1. The PWM brightness signals of each of the other LED strings in the system 100 may have features similar to those depicted in FIG. 2B, and the overall brightness signal of the LEDs in the system 100 is a superposition of each individual brightness signal, each with its own unique modulation frequency (and, generally, its own unique duty cycle). The superimposed PWM brightness signals may therefore include a first PWM brightness signal having an amplitude proportional to the brightness of LED string 110-1 and having a frequency and duty cycle corresponding to channel 102-1, a second PWM brightness signal having an amplitude proportional to the brightness of LED string 110-2 and having a frequency and duty cycle corresponding to channel 102-2, and up to an nth PWM brightness signal having an amplitude proportional to the brightness of LED string 110-N and having a frequency and duty cycle corresponding to channel 102-N. It may be understood that the change in amplitude of the brightness signal may be proportional to the uncontrolled changes in LED brightness. Back to FIG. 1, the photodetector circuitry 112 may be a broadband light detection device configured with an optical response spanning the full color spectrum of all the LEDs in the system and configured with a relatively "flat" electrical frequency response across the range of modulation frequencies f1, f2, . . . , fN. Photodetector circuitry 112 may be positioned in close proximity to the LED strings to enable the detector 112 to receive and detect light from the LED strings, and to reduce or eliminate interference from external light sources. Optically transluscent diffusers such as those commonly used in LED light sources may also be used to reduce or eliminate interference from external light sources. Known broadband photodetectors that may be used in accordance with this disclosure include, for example, the OSRAM Opto Semiconductors phototransistor SFH3710, the Vishay photodiode TEMT6200FX01 and the Vishay photodiode TEMD6200FX01. The output 114 of photodetector circuitry 112 may include a composite brightness signal represented as an electrical signal proportional to the superimposed PWM brightness signals from the LED sources in the system.

LED controller circuitry 118 may include frequency and amplitude detection circuitry 120 and error processor circuitry 124. As an overview, controller circuitry 118 may be configured to receive the LED brightness signal 114 (as may be amplified by amplifier 116), and detect the product of the amplitude and duty cycle, hereinafter referred to as the "pulse area", of each respective PWM brightness signal superimposed within the LED brightness signal at each respective unique modulating frequency. Controller circuitry 118 may also generate signals proportional to the pulse area ("pulse area signals") and compare the pulse area signals to user defined and/or preset brightness values to generate error signals proportional to the difference between the detected brightness and the user defined and/or preset brightness values. Frequency and amplitude detection circuitry 118 may include a plurality of physical and/or logical detector circuits 120-1, 120-2, . . . , 120-N. Each respective detector circuit 120-1, 120-2, . . . , 120-N may be configured to filter the signal 114 at each respective modulation frequency f1, f2, . . . fN and detect the amplitude of each respective signal at the respective modulation frequency. Thus, as an example, circuit 120-1 may be configured to filter the incoming LED brightness signal 114 (which is the composite signal of superimposed PWM brightness signals) to filter out all of the signals except the PWM brightness signal having a frequency of f1 (being emitted by the LED string 110-1). Once the appropriate PWM brightness signal is isolated from the collection of signals in signal 114, circuit 120-1 may be configured to detect the pulse area of the PWM brightness signal at frequency f1. Each of circuits 120-2-120N may be configured in a similar manner to filter and detect at their respective modulation frequencies, and to generate pulse area signals 122-2-122-N proportional to the respective pulse area of the PWM brightness signal.

Figure 3:
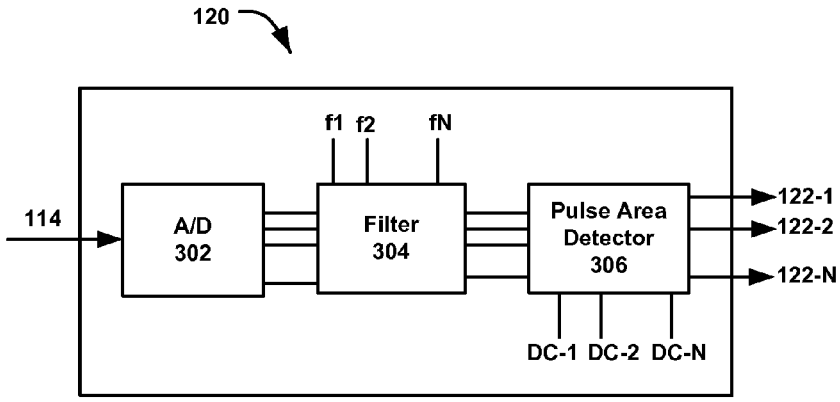
FIG. 3 is a block diagram of an exemplary embodiment of frequency and amplitude detection circuitry consistent with the present disclosure.

FIG. 3 is a block diagram of an exemplary embodiment of frequency and amplitude detection circuitry 120 consistent with the present disclosure. In this embodiment, circuitry 120 may include an A/D converter circuit 302 configured to digitize signal 114. The sampling rate and bit depth of circuit 302 may be selected on, for example, a desired resolution in the digital signal. To that end, the sampling rate may be selected to avoid aliasing, i.e., selected to be greater than or equal to twice the largest modulation frequency among f1, f2, . . . , fN. Circuitry 120 may also include a filter circuit 304. Filter circuit 304 may be configured to filter the signal to isolate each respective PWM brightness signal modulated at respective modulation frequencies f1, f2, . . . , fN. In addition, filter circuitry 304 may be configured to filter the incoming signal 114 to reduce or eliminate high frequency components in the signal 114 (e.g., low pass filtering techniques). Known filtering techniques may be used including, for example, Fourier Transform (FT), fast Fourier Transform (FFT), phase sensitive detection methods, etc.

Figure 2C:
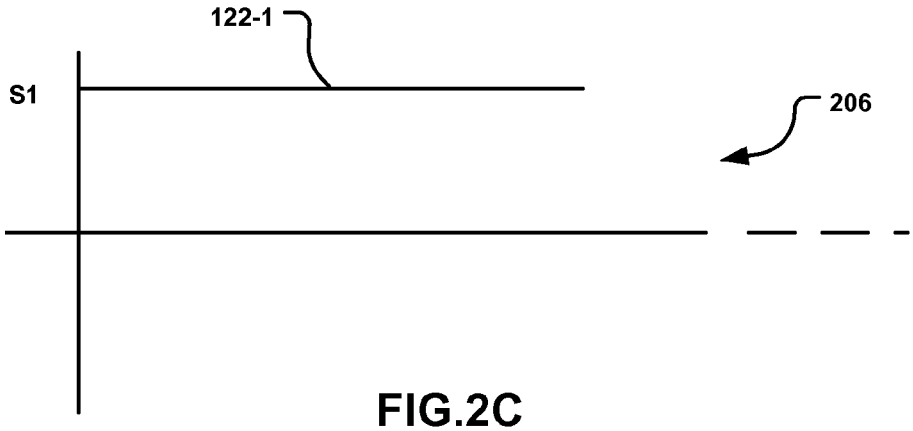
FIG. 2C is a signal diagram of a pulse area signal consistent with the present disclosure.

Circuitry 120 may also include pulse area detection circuitry 306. Pulse area detection circuitry 306 may be configured to detect a pulse area of each respective PWM brightness signal at each respective modulation frequency f1, f2, . . . , fN and for each respective duty cycle. The output of pulse area detection circuitry 306 may includes a plurality of pulse area signals 122-1, 122-2, . . . , 122-N that are proportional to the respective pulse area of each channel, i.e., proportional to the product of the amplitude and the duty cycle of each PWM brightness signal for each channel. FIG. 2C provides an example of an pulse area signal 206 for channel 102-1. In this example, signal 122-1 is generally a DC signal having an amplitude that is proportional to the pulse area of the PWM brightness signal for channel 102-1. In this example, the amplitude of signal 122-1 has a value S1, where S1 is a function of both the amplitude (flux) of the light emitted by LED string 110-1 and the duty cycle of channel 102-1. Of course, each pulse area signals from the other channel in the system may have similar features as those depicted in FIG. 2C. Changes in the pulse area signal (i.e., changes in the DC value S) may be proportional to uncontrolled changes in the brightness of subject LED string.

While the foregoing description of the frequency and amplitude detection circuitry 120 may utilize digital filtering and detection, in other embodiments the circuitry 120 may include hardwired circuitry to perform operations as described above. For example, filter circuits may be formed using known electronic components (transistors, resistors, capacitors, amplifiers, etc.) and each may be tuned to filter at a specific frequency, e.g., f1, f2, . . . , fN. Similarly, amplitude detection circuits and multiplier circuits may be formed using hardwired circuitry to perform operations as described above.

Figure 4:
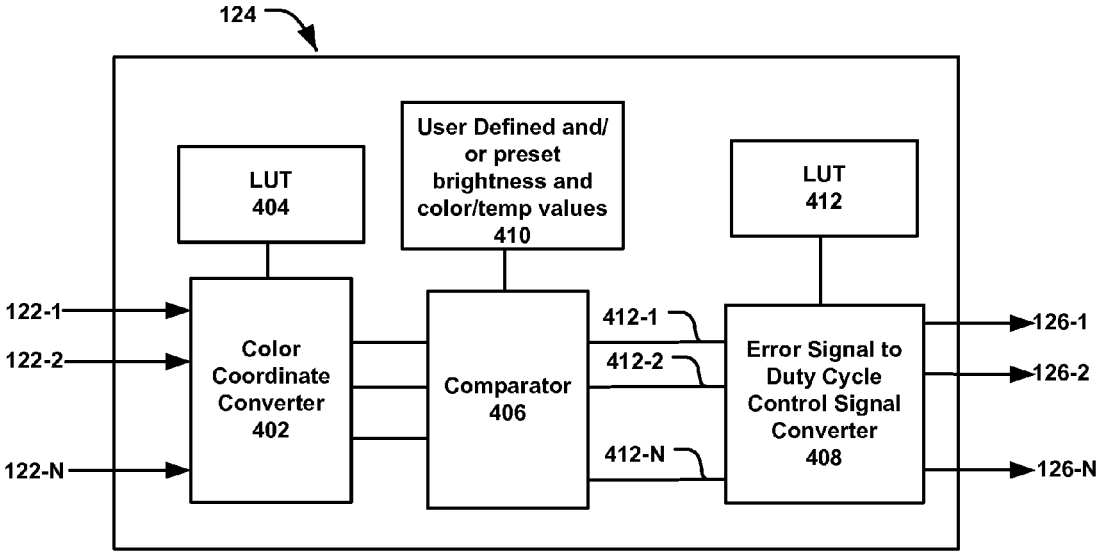
FIG. 4 is a block diagram of an exemplary embodiment of error processor circuitry consistent with the present disclosure.

FIG. 4 is a block diagram of an exemplary embodiment of an error processor circuitry 124 consistent with the present disclosure. In this embodiment, circuitry 124 may include color coordinate converter circuitry 402. Circuitry 402 may be configured to convert the set of pulse area signals 122-1, 122-2, . . . , 122-N into a set of N values that define the light source in terms of standard photometric quantities. For example: for N=3, the output of color coordinate converter 402 may be an x,y point in a chromaticity space and a single luminance value. Examples of known chromaticity space domains include xyz, uvw, Luv Lab, etc., however, other known or after-developed chromaticity space domains may be used. For example, circuitry 402 may comply or be compatible with a color space defined by the International Commission on Illumination (C.I.E) which defines an RGB color space into a luminance ("Y") parameter, and two color coordinates x and y which may correlate to points on a known chromaticity diagram. Using the (x,y,Y) space as an example, circuitry 402 may be configured to convert the signals 122-1, 122-2, . . . , 122-N, where N is greater than or equal to 3, into a single set of x, y, and Y coordinates and additional photometric quantities up to N total values. A look-up table 404 (LUT), created by calibrating the light source with a photometer or similar instrument (described below), may be an N×N matrix of numbers which correlates the signals 122-1, 122-2, . . . , 122-N to the coordinate space of choice. Thus, as a further example: for N=4, the output of circuitry 402 may be the vector (x,y,Y), and a single number representing the color rendering index (CRI) of the source, a well known photometric quantity.

Comparator circuitry 406 may be configured to compare the space coordinates from circuitry 402 to a user defined and/or programmed set of values 410. The values 410 may represent the target or desired overall brightness and/or color (temperature) of the LED strings. Continuing with the N=3 example given above, comparator 406 may be configured to compare the (x, y, Y) data point of the detected signal with the (x, y, Y) data point of the preset and/or user defined values 410. The output of comparator 406 may be a set of error signals 412-1, 412-2, 412-3 in the selected (x,y,Y) space. Thus, for example, error signal 412-1 may include a value representing the difference between the measured x chromaticity value of the source and the preset and/or user definable value 410. Similarly, error signals 412-2 and 412-3 may be generated for the y and Y coordinate.

While the error signals 412-1, 412-2, . . . 412-N may represent a difference between a target and actual set point for the light source, these signals may be converted back into a signal form usable by the PWM circuitry. To that end, error processor circuitry 124 may also include error signal to duty cycle control signal converter circuitry 408. Circuitry 408 may be configured to receive the error signals 412-1, 412-2, . . . 412-N in the selected space coordinates and convert those signals into respective control signals 126-1, 126-2, . . . , 126-N that are in a form that is usable by respective PWM circuitry 104-1, 104-2, . . . , 104-N. To that end, circuitry 124 may include a second LUT 412 that circuitry 408 may use to correlate the error signals in the selected chromaticity space to a DC value. In one embodiment, LUT 412 may include the same information as LUT 404 but represented in an inverse fashion to enable circuitry 408 to determine a DC value based on the inputs (i.e., LUT 412 may be the inverse of LUT 404. Thus, control signals 126-1, 126-2, . . . , 126-N may be DC signals having values based on the error detected by comparator circuitry 406. In operation, control signals 126-1, 126-2, . . . , 126-N may control respective PWM circuitry 104-1, 104-2, . . . , 104-N to adjust the respective duty cycle in proportion to a detected error in each photometric quantity. One example of error processor circuitry that may be utilized with the present application is the PIC24F MCU family of microprocessors manufactured by Microchip Technology Inc., and described in Microchip Application Note AN1257 published by Microchip Technology Inc.

The calibration of a light source with feedback properties as described herein is for the purpose of generating LUT 404 and the LUT 412 in FIG. 4. The LUT maps the N pulse area signals 122-1, 122-2, . . . 122-N of the light source to N standard photometric quantities. The N photometric quantities can include x,y chromaticity, Y luminance, CRI, correlated color temperature (CCT), etc. Calibration proceeds with selective activation of each color in the light source to the exclusion of all others. Each color may be activated at the 100% luminance level. An instrument, e.g., a Photometer, calibrated to measure the photometric properties of each LED string 1, 2, . . . N may be used, and yields N vectors each with N values ($s_1$, $s_2$, . . . $s_N$). The N vectors are then used to create an N×N matrix which defines the LUT. For example and for the case N=3, Microchip Application Note AN1257 published by Microchip Technology Inc. describes this type of calibration process in detail. Typically, calibration occurs when the LED strings are installed or one or more strings are changed.

Figure 5:
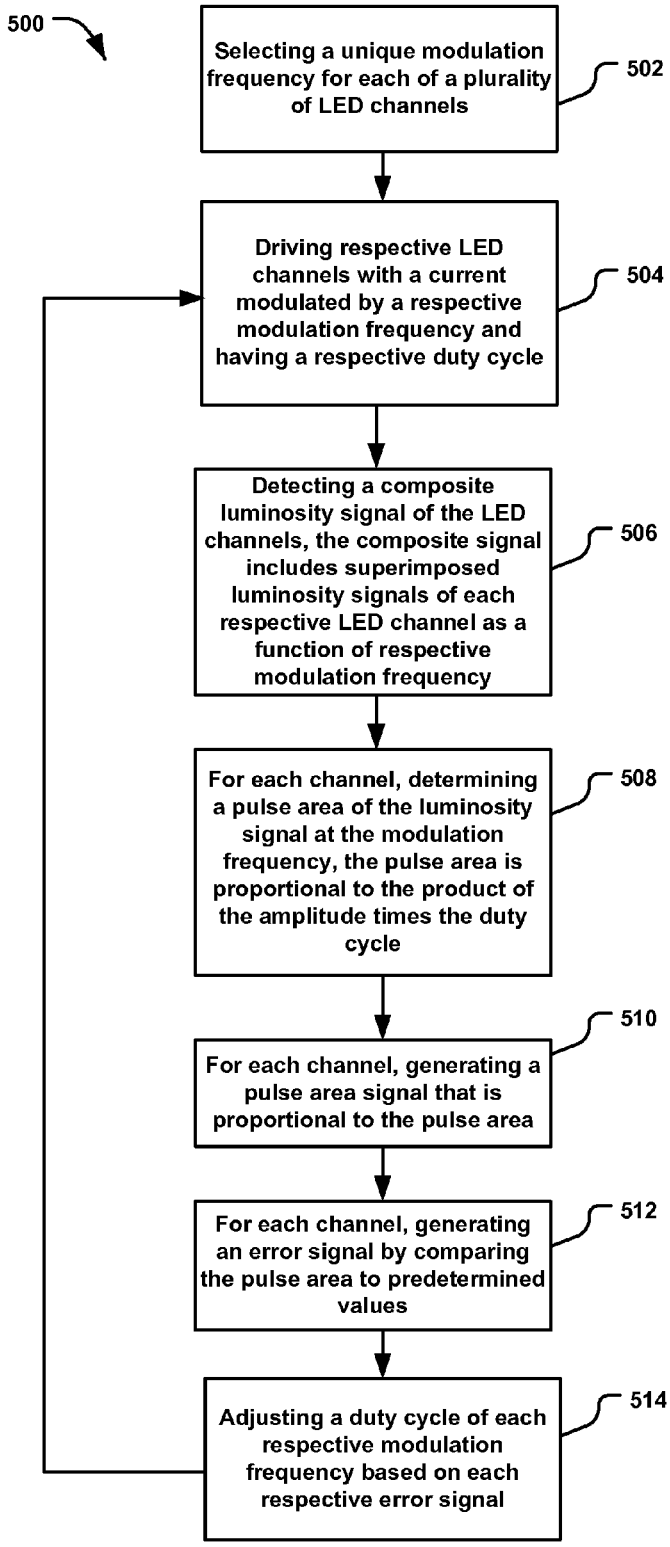
FIG. 5 is a block flow diagram of an exemplary method consistent with the present disclosure.

FIG. 5 is a block flow diagram 500 of one exemplary method consistent with the present disclosure. The method according to this embodiment may include selecting a unique modulation frequency for each of a plurality of LED channels 502. Each unique modulation frequency may be selected to reduce or eliminate flicker on each channel, and to reduce or eliminate beat effects between channels. Operation 504 may include driving respective LED channels with a current modulated by a respective unique modulation frequency. Each modulated current signal may have a respective duty cycle to deliver controllable current to the LED channel. Operations may also include detecting a composite luminosity signal of the LED channels, the composite signal includes superimposed luminosity signals of each LED channel as a function of respective modulation frequency 506. Thus, in one embodiment, the brightness signals of each LED channel may be detected simultaneously.

Operations according to the method of this embodiment may also include, for each channel, determining a pulse area of the luminosity signal at the modulation frequency 508. The pulse area is proportional to the product of the amplitude of the luminosity signal times the duty cycle of the luminosity signal. For each channel, the method may also include generating a pulse area signal that is proportional to the pulse area 510. Operations according to this embodiment may also include, for each channel, generating an error signal by comparing the pulse area signal to predetermined values 512. The predetermined values may be, for example, preset or user programmable values of brightness and/or color. The error signals may represent a difference between the pulse area signals and the predetermined values. Operations of this embodiment may also include adjusting a duty cycle of a respective modulation frequency based on a respective error signal 514. This operation may include controlling a PWM signal generator to control the duty cycle of the PWM signal based on the error signal. In this embodiment, the method may enable continuous and simultaneous feedback control of the LED channels by continuing operations at 504.

While FIG. 5 depicts exemplary operations according to one embodiment, it is to be understood that other embodiments of the present disclosure may include subcombinations of the operations depicted in FIG. 5 and/or additional operations described herein. Thus, claims presented herein may be directed to all or part of the components and/or operations depicted in one or more figures. In addition, there is no requirement that the operations depicted in FIG. 5, or described elsewhere herein, need to occur in the order presented, unless stated otherwise.

As used in any embodiment herein, "circuitry" may comprise, for example, singly or in any combination, hardwired circuitry, programmable circuitry, state machine circuitry, and/or firmware that stores instructions executed by programmable circuitry. In at least one embodiment, controller 118, photodetector 112, PWM circuitry 104 and/or driver circuitry 106 may collectively or individually comprise one or more integrated circuits. An "integrated circuit" may be a digital, analog or mixed-signal semiconductor device and/or microelectronic device, such as, for example, but not limited to, a semiconductor integrated circuit chip.

Embodiments of the methods described herein may be implemented using one or more processors and/or other programmable device. To that end, the operations described herein may be implemented on a tangible computer readable medium having instructions stored thereon that when executed by one or more processors perform the operations. Thus, for example, controller 118 may include a storage medium (not shown) to store instructions (in, for example, firmware or software) to perform the operations described herein. The storage medium may include any type of tangible medium, for example, any type of disk including floppy disks, optical disks, compact disk read-only memories (CD-ROMs), compact disk rewritables (CD-RWs), and magneto-optical disks, semiconductor devices such as read-only memories (ROMs), random access memories (RAMs) such as dynamic and static RAMs, erasable programmable read-only memories (EPROMs), electrically erasable programmable read-only memories (EEPROMs), flash memories, magnetic or optical cards, or any type of media suitable for storing electronic instructions.

Unless specifically stated otherwise, terms such as "operations," "processing," "computing," "calculating," "comparing," generating," "determining," or the like, may refer to the action and/or processes of a processing system, hardwire electronics, or an electronic computing device or apparatus, that manipulate and/or transform data represented as physical, such as electronic, quantities within, for example, registers and/or memories into other data similarly represented as physical quantities within the registers and/or memories.

Thus, in one embodiment, the present disclosure provides an LED controller that includes detection circuitry configured to receive an LED brightness signal having a plurality of superimposed PWM brightness signals each having a duty cycle and a unique modulation frequency. Each PWM brightness signal is proportional to the brightness of a respective LED channel. The detection circuitry is further configured to determine a pulse area for each respective PWM brightness signal. The pulse area is proportional to the product of the amplitude and duty cycle of each respective PWM brightness signal at each respective unique frequency. The detection circuitry is further configured to generate respective pulse area signals proportional to the respective pulse area. Error processor circuitry is provided to compare the respective pulse area signals to user defined and/or preset photometric quantities and generate respective error signals proportional to the difference between the respective pulse area signals and the user defined and/or preset photometric quantities.

In another embodiment, the present disclosure provides a method for controlling a plurality of LED channels. The method includes receiving an LED brightness signal having a plurality of superimposed PWM brightness signals each having a duty cycle and a unique modulation frequency, each PWM brightness signal being proportional to the brightness of a respective LED channel. The method also includes determining a pulse area of each PWM brightness signal at each respective unique frequency, the pulse is being proportional to the product of the amplitude and duty cycle of each respective PWM brightness signal at each respective unique frequency. The method also includes generating respective pulse area signals proportional to the respective pulse area. The method also includes comparing each respective pulse area signal to user defined and/or preset photometric quantities and generate respective error signals proportional to the difference between the respective pulse area signals and the user defined and/or preset photometric quantities.

In another embodiment, the present disclosure provides an apparatus that includes at least one storage medium having stored thereon, individually or in combination, instructions. The instructions, when executed by at least one processor, result in the following operations including receiving an LED brightness signal having a plurality of superimposed PWM brightness signals each having a duty cycle and a unique modulation frequency, each PWM brightness signal being proportional to the brightness of a respective LED channel; determining a pulse area of each PWM brightness signal at each respective unique frequency, the pulse area being proportional to the product of the amplitude and duty cycle of each respective PWM brightness signal at each respective unique frequency; generating respective pulse area signals proportional to the respective pulse area; and comparing the respective pulse area signal to user defined and/or preset photometric quantities and generating respective error signals proportional to the difference between the respective pulse area signals and the user defined and/or preset photometric quantities.

In still another embodiment, the present disclosure provides a system that includes a plurality of light emitting diode (LED) channels, each channel comprising pulse width modulation (PWM) circuitry configured to generate a PWM signal at a unique modulation frequency and a duty cycle, driver circuitry configured to generate a current modulated by the respective PWM signal and controlled by the duty cycle, and an LED string configured to be driven by the driver circuitry and to generate a PWM brightness signal having a brightness corresponding to the duty cycle of the PWM signal. The system also includes a photodetector circuit configured to receive each brightness signal from each LED string, and generate a proportional LED brightness signal that includes superimposed PWM brightness signals each having a duty cycle and amplitude at the unique modulation frequency. The system also includes an LED controller configured to receive the proportional LED brightness signal, to determine a pulse area of each PWM brightness signal at each respective unique frequency, the pulse area being proportional to the product of an amplitude and duty cycle of each respective PWM brightness signal at each respective unique frequency; generate respective pulse area signals proportional to the respective pulse area; and compare the respective pulse area signal to user defined and/or preset photometric quantities and generate respective error signals proportional to the difference between the respective pulse area signals and the user defined and/or preset photometric quantities.

Thus, the embodiments described herein may be configured to compensate, via negative feedback, for unintended changes in brightness in one or more LED channels by changing the duty cycle for one or more LED channels in proportion to the error signal and thereby reducing the total error signal towards zero. Advantageously, by simultaneously processing the brightness information in each channel, the present disclosure can make continuous duty cycle adjustments to accurately control brightness and color in each LED channel. In addition, modulating each channel with a unique modulation may enable inexpensive detection and may further enhance simultaneous control of the channels. Also, modulating each channel with a unique modulation frequency may enable the use of a broadband photodetector, instead of more costly multichannel detectors or single channel detectors with colored filters over each detector.

Modifications and substitutions by one of ordinary skill in the art are considered to be within the scope of the present disclosure, which is not to be limited except by the following claims.

What is claimed is:

1. A light emitting diode (LED) controller, comprising:

detection circuitry configured to receive an LED brightness signal having a plurality of superimposed PWM brightness signals each having a duty cycle and a unique modulation frequency, each PWM brightness signal being proportional to the brightness of a respective LED channel; the detection circuitry is further configured to determine a pulse area for each respective PWM brightness signal, the pulse area being proportional to the product of the amplitude and duty cycle of each respective PWM brightness signal at each respective unique frequency; the detection circuitry is further configured to generate respective pulse area signals proportional to the respective pulse area; and error processor circuitry configured to compare the respective pulse area signals to user defined and/or preset photometric quantities and generate respective error signals proportional to the difference between the respective pulse area signals and the user defined and/or preset photometric quantities.

2. The controller of claim 1, wherein:

the error processing circuitry is further configured to generate respective control signals based on respective error signals, the control signals are configured to control a respective duty cycle of a respective unique modulation frequency in a respective LED channel.

3. The controller of claim 1, wherein:

each unique modulation frequency is selected to be at least 500 Hertz, and each unique frequency is selected to be at least 200 Hertz from other unique frequencies.

4. The controller of claim 1, wherein:

the error processing circuitry is further configured to convert the pulse area signals into photometric quantities, and wherein the error processing circuitry is further configured to compare parameters of the pulse area signals to the corresponding parameters of the user defined and/or preset photometric quantities.

5. The controller of claim 1, wherein:

the detector circuitry is further configured to filter the LED brightness signal at each unique frequency to simultaneously isolate each PWM brightness signal.

6. The controller of claim 1, further comprising:

a broadband photodetector circuit configured to receive PWM brightness signals from each of a plurality of LED channels and output a signal proportional to the LED brightness signal, the photodetector circuit is further configured to have a relatively flat frequency response across the range of unique modulation frequencies.

7. A method, comprising:

receiving an LED brightness signal having a plurality of superimposed PWM brightness signals each having a duty cycle and a unique modulation frequency, each PWM brightness signal being proportional to the brightness of a respective LED channel;

determining a pulse area of each PWM brightness signal at each respective unique frequency, the pulse area being proportional to the product of the amplitude and duty cycle of each respective PWM brightness signal at each respective unique frequency;

generating respective pulse area signals proportional to the respective pulse area; and comparing the respective pulse area signal to user defined and/or preset photometric quantities and generating respective error signals proportional to the difference between the respective pulse area signals and the user defined and/or preset photometric quantities.

8. The method of claim 7, further comprising:

selecting each unique modulation frequency to be at least 500 Hertz, and selecting each unique frequency to be at least 200 Hertz from other unique frequencies.

9. The method of claim 7, further comprising:

generating respective control signals based on respective error signals, the control signals are configured to control a respective duty cycle of a respective unique modulation frequency in a respective LED channel.

10. The method of claim 7, further comprising:

converting the pulse area signals into photometric quantities; and comparing parameters of the pulse area signals to the corresponding parameters of the user defined and/or preset photometric quantities.

11. The method of claim 7, further comprising:

filtering the LED brightness signal at each unique frequency to simultaneously isolate each PWM brightness signal.

12. The method of claim 7, further comprising:

simultaneously generating the error signals for each LED channel.

13. An apparatus, comprising one or more storage mediums having stored thereon, individually or in combination, instructions that when executed by one or more processors result in the following operations comprising:

receiving an LED brightness signal having a plurality of superimposed PWM brightness signals each having a duty cycle and a unique modulation frequency, each PWM brightness signal being proportional to the brightness of a respective LED channel;

determining a pulse area of each PWM brightness signal at each respective unique frequency, the pulse area being proportional to the product of the amplitude and duty cycle of each respective PWM brightness signal at each respective unique frequency;

generating respective pulse area signals proportional to the respective pulse area; and comparing the respective pulse area signal to user defined and/or preset photometric quantities and generating respective error signals proportional to the difference between the respective pulse area signals and the user defined and/or preset photometric quantities.

14. The apparatus of claim 13, wherein the instructions that when executed by one or more of the processors result in the following additional operations comprising:

selecting each unique modulation frequency to be at least 500 Hertz, and selecting each unique frequency to be at least 200 Hertz from other unique frequencies.

15. The apparatus of claim 13, wherein the instructions that when executed by one or more of the processors result in the following additional operations comprising:

generating respective control signals based on respective error signals, the control signals are configured to control a respective duty cycle of a respective unique modulation frequency in a respective LED channel.

16. The apparatus of claim 13, wherein the instructions that when executed by one or more of the processors result in the following additional operations comprising:

converting the pulse area signals into photometric quantities, and comparing parameters of the pulse area signals to the corresponding parameters of the user defined and/or preset photometric quantities.

17. The apparatus of claim 13, wherein the instructions that when executed by one or more of the processors result in the following additional operations comprising:

filtering the LED brightness signal at each unique frequency to simultaneously isolate each PWM brightness signal.

18. The apparatus of claim 13, wherein the error signals are generated simultaneously for each LED channel.

19. A system, comprising:

a plurality of light emitting diode (LED) channels, each channel comprising pulse width modulation (PWM) circuitry configured to generate a PWM signal at a unique modulation frequency and a duty cycle, driver circuitry configured to generate a current modulated by the respective PWM signal and controlled by the duty cycle, and an LED string configured to be driven by the driver circuitry and to generate a PWM brightness signal having a brightness corresponding to the duty cycle of the PWM signal;

a photodetector circuit configured to receive each brightness signal from each LED string, and generate a proportional LED brightness signal that includes superimposed PWM brightness signals each having a duty cycle and amplitude at the unique modulation frequency; and an LED controller configured to:

receive the proportional LED brightness signal, to determine a pulse area of each PWM brightness signal at each respective unique frequency, the pulse area being proportional to the product of an amplitude and duty cycle of each respective PWM brightness signal at each respective unique frequency;

generate respective pulse area signals proportional to the respective pulse area; and compare the respective pulse area signal to user defined and/or preset photometric quantities and generate respective error signals proportional to the difference between the respective pulse area signals and the user defined and/or preset photometric quantities.

20. The system of claim 19, wherein:

the LED controller is further configured to generate respective control signals based on respective error signals, the respective control signals are configured to control the PWM circuitry to adjust a respective duty cycle of a respective unique modulation frequency in a respective LED channel.

21. The system of claim 19, wherein:

each unique modulation frequency is selected to be at least 500 Hertz, and each unique frequency is selected to be at least 200 Hertz from other unique frequencies.

22. The system of claim 19, wherein:

the LED controller is further configured to convert the pulse area signals into photometric quantities, and compare parameters of the pulse area signals to the corresponding parameters of the user defined and/or preset photometric quantities.

23. The system of claim 19, wherein:

the LED controller is further configured to filter the proportional LED brightness signal at each unique frequency to simultaneously isolate each PWM brightness signal.

24. The system of claim 19, wherein:

the photodetector circuit comprises a broadband photodetector configured to have a relatively flat frequency response across the range of unique modulation frequencies.

25. The system of claim 19, wherein:

the driver circuitry comprises a current controlled DC/DC converter circuit configured to generate a constant DC current.

* * * * *